US007181931B2

(12) United States Patent
White

(10) Patent No.: US 7,181,931 B2
(45) Date of Patent: Feb. 27, 2007

(54) METHOD AND APPARATUS FOR FITTING CHAIN JEWELRY ASSEMBLY ON AN INDIVIDUAL

(76) Inventor: Dennis M. White, 12660 N. 42nd Dr., Phoenix, AZ (US) 85029

( * ) Notice: Subject to any disclaimer, the term of this patent is extended or adjusted under 35 U.S.C. 154(b) by 0 days.

(21) Appl. No.: 11/068,399

(22) Filed: Feb. 28, 2005

(65) Prior Publication Data

US 2006/0191291 A1 Aug. 31, 2006

(51) Int. Cl.
*A44C 15/00* (2006.01)

(52) U.S. Cl. ..... 63/33; 63/3

(58) Field of Classification Search ..... 63/3, 63/3.1, 3.2, 4, 1.16, 38, 41, 33; 245/4; 59/80
See application file for complete search history.

(56) References Cited

U.S. PATENT DOCUMENTS 1,556,106 A * 10/1925 Hamilton ..... 63/1.11
5,195,335 A * 3/1993 Hart ..... 63/3.2
5,644,935 A * 7/1997 Jonovich et al. ..... 63/4

* cited by examiner

*Primary Examiner*—Jack W. Lavinder
(74) *Attorney, Agent, or Firm*—Tod R. Nissle, P.C.

(57) ABSTRACT

A jewelry assembly is provided that extends around the neck and waist and down the front and back of an individual. The jewelry assembly is constructed such that it remains centered when worn and such that it can be adapted to fit individuals of different size.

2 Claims, 5 Drawing Sheets

METHOD AND APPARATUS FOR FITTING CHAIN JEWELRY ASSEMBLY ON AN INDIVIDUAL

This invention relates to a method and apparatus for fitting jewelry.

More particularly, the invention relates to a method and apparatus for fitting jewelry to complement the appearance of a woman by draping a single piece of chain jewelry about the neck, waist, front and back of a woman.

The use of necklaces and bracelets is common. The use of chains that extend around the midriff of a woman as jewelry does not appear to be known. More importantly, a single piece of jewelry that drapes over the neck, midriff, chest and back to draw attention to and complement the appearance of a woman does not appear known.

Jewelry that would drape simultaneously around the neck, around the waist, and intermediate the neck and waist is difficult to fit to a user because of variances in neck and waist sizes and differences in the heights of the users.

Accordingly, it would be highly desirable to provide jewelry that can be configured to extend simultaneously about the neck and waist and intermediate the neck and waist to complement the appearance of a woman and that can be fitted to a woman.

Therefore, it is a principal object of the invention to provide improved jewelry configurable to fit about the torso of a woman and to provide an improved method for fitting the jewelry to women that wear different clothing sizes.

These and other, further and more specific objects and advantages of the invention will be apparent from the following detailed description of the invention, taken in conjunction with the drawings, in which.

Figure 1:
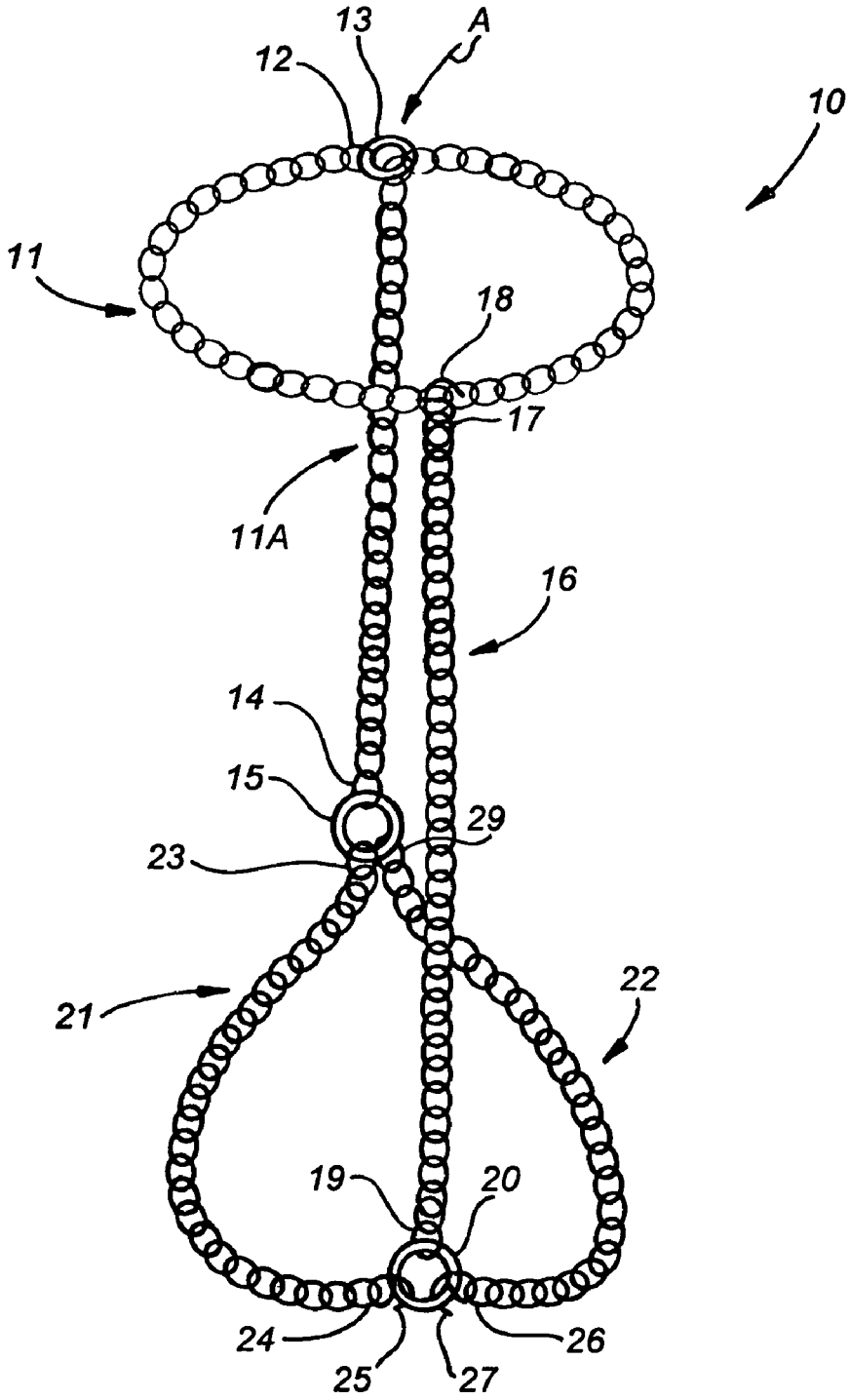
FIG. 1 is a perspective view illustrating a jewelry system constructed in accordance with the principles of the invention.

Briefly, in accordance with my invention, I provide an improved method to fit a jewelry chain assembly extending over a woman's neck, chest, back, stomach, belly button, and waist to complement the woman's appearance. The method comprises the steps of providing a neck assembly comprising a necklace worn about the woman's neck and having a front and a back; a first chain to extend from the necklace downwardly over the woman's back, the chain having a first end connected to the back of the necklace and a second end positioned on the woman's back; apparatus for adjusting the effective length of the first chain; a second chain to extend from the necklace downwardly over the woman's chest and stomach, the necklace having a first end connected to the front of the necklace and a second end positioned over the woman's belly button; a third chain having a first end connected to the second end of the first chain and having a second end; a first clip for detachably securing the second end of the third chain to the second end of the second chain; a fourth chain having a first end connected to the second end of the first chain and having a second end; and, a second clip for detachably securing the second end of the fourth chain to second end of the second chain. The method also includes the step of placing the necklace on the woman's neck such that the second chain extends from the necklace downwardly over the woman's chest and stomach and the second end of the second chain is positioned over the woman's belly button; such that the first chain extends from the necklace downwardly over the woman's back; and, such that the second and third chains extend from the second end of the first chain. The method includes the steps of using the first clip to secure the second end of the third chain to the second end of the second chain such that the third chain drapes from the woman's belly button about the woman's waist; and, using the second clip to secure the second end of the fourth chain to the second end of the second chain such that the fourth chain drapes from the woman's belly button about the woman's waist.

In another embodiment of the invention, I provide an improved method to fit a jewelry chain assembly over a woman's neck, chest, back, stomach, belly button, and waist to complement the woman's appearance. The method comprises the step of providing a neck assembly comprising a necklace worn about the woman's neck and having a front and a back; a first chain to extend from the necklace downwardly over the woman's back, the chain having a length, a first end connected to the back of the necklace and a second end positioned on the woman's back; apparatus for adjusting slidably the effective length of the first chain; a second chain to extend from the necklace downwardly over the woman's chest and stomach, the necklace having a first end connected to the front of the necklace and a second end positioned over the woman's belly button; a third chain having a first end connected to the second end of the first chain and having a second end; a first clip for detachably securing the second end of the third chain to the second end of the second chain; a fourth chain having a first end connected to the second end of the first chain and having a second end; and, a second clip for detachably securing the second end of the fourth chain to second end of the second chain. The method also comprises the step of placing the necklace on the woman's neck such that the second chain extends from the necklace downwardly over the woman's chest and stomach and the second end of the second chain is positioned over the woman's belly button; such that the first chain extends from the necklace downwardly over the woman's back; such that the second and third chains extend from the second end of the first chain; and, such that the effective length of the first chain is slidably adjusted. The method also includes the steps of using the first clip to secure the second end of the third chain to the second end of the second chain such that the third chain drapes from the woman's belly button about the woman's waist; and, using the second clip to secure the second end of the fourth chain to the second end of the second chain such that the fourth chain drapes from the woman's belly button about the woman's waist.

In a further embodiment of the invention, I provide an improved jewelry chain assembly to fit on a woman's neck, chest, back, stomach, sides, belly button, spine, and waist to complement the woman's appearance. The jewelry chain assembly comprises a neck assembly comprising a necklace worn about the woman's neck and having a front and a back; a back chain to extend from the necklace downwardly along the spine and over the woman's back, the chain having a first end connected to the back of the necklace and a second end positioned on the spine; apparatus for adjusting the effective length of the first chain; a front chain to extend from the necklace downwardly over the woman's chest and stomach, the front chain having a first end connected to the front of the necklace and a second end positioned over the woman's belly button; a first girdle chain to extend from the woman's belly button along the woman's waist and around one of the woman's sides having a first end connected to the second end of the back chain and having a second end; a first clip for detachably securing the second end of the first girdle chain to the second end of the front chain; a second girdle chain to extend from the woman's belly button along the woman's waist and the other one of the woman's sides and having a first end connected to the second end of the back chain and having a second end; and, a second clip for detachably securing the second end of the second girdle chain to second end of the front chain.

Turning now to the drawings, which depict the presently preferred embodiments of the invention for the purpose of illustrating the practice thereof and not by way of limitation of the scope of the invention, and in which like reference characters refer to corresponding elements throughout the several views, FIG. 1 illustrates a jewelry assembly constructed in accordance with the invention and including a neck assembly including a necklace assembly including a chain 11 having a first end 12 and a second end 14. Ring 13 is connected to first end 12. Ring 15 is connected to second end 14. Since one end of chain 11 slides through ring 13, the length of the portion 11A of chain 11 that extends from ring 13 to ring 15 is adjustable by sliding one end of chain 11 through ring 13. Sliding one end of chain 11 through ring 13 also permits adjustment of the diameter, or size, of the portion of chain 11 that extends around the neck of a user and that, consequently, forms a necklace. Ring 13 is at the back of the necklace. Any other desired apparatus can be provided to adjust the length of portion 11A. For example, portion 11A can be a separate piece of chain that is cut to a desired size and that is connected at its ends to ring 13 and ring 15. Or, portion 11A can be a separate piece of chain that has a clip or hook attached to its upper end so that the end of the chain with the clip can be passed upwardly through ring 13 and back down over the outside of ring 13, and then hooked through the separate piece of chain at a desired point along the separate piece of chain. And so on.

A second chain 16 extends downwardly from the necklace formed by chain 11. Chain 16 includes upper end 17 and lower end 19. Lower end 19 is connected to ring 20. Upper end 17 is connected to clip 18. Clip 18 removably secures chain 16 to the front of necklace 11. Clip 18 enables the length of chain 16 to be shortened by wrapping the upper end of chain 16 around the front of the necklace chain and back along chain 16 and by inserting clip 18 into chain 16 at the desired location.

A third chain 21 includes ends 23 and 24. End 23 is fixedly connected to ring 15 but can be detachably connected to ring 15 with a clip or other fastener. Clip 25 attached to end 24 removably connects chain 21 to ring 20.

A fourth chain 22 includes ends 26 and 29. End 26 is fixedly connected to ring 15 but can be detachably connected to ring 15 with a clip or other fastener. Clip 27 attached to end 26 removably connects chain 22 to ring 20.

In use of the jewelry assembly of FIG. 1, clips 25 and 27 are detached from ring 20. The end 14 of chain 11 extending downwardly through ring 13 is removed from ring 13 and chain 11 is fit around the neck of the user and end 14 is directed back through ring 13 in the direction of arrow A until the portion of chain 11 forming a necklace fits comfortably about the neck of the user. The necklace need not consist of a chain 11 and can have any desired constructed including, without limitation, a solid C-shaped metal piece that has a chain that interconnects the ends of the metal piece and "closes" the "C" such that the metal piece and chain together extend completely around the neck of the user. The necklace could also comprise tubular rigid pieces of metal pivotally connected end-to-end to extend around the neck of the user.

Figure 2:
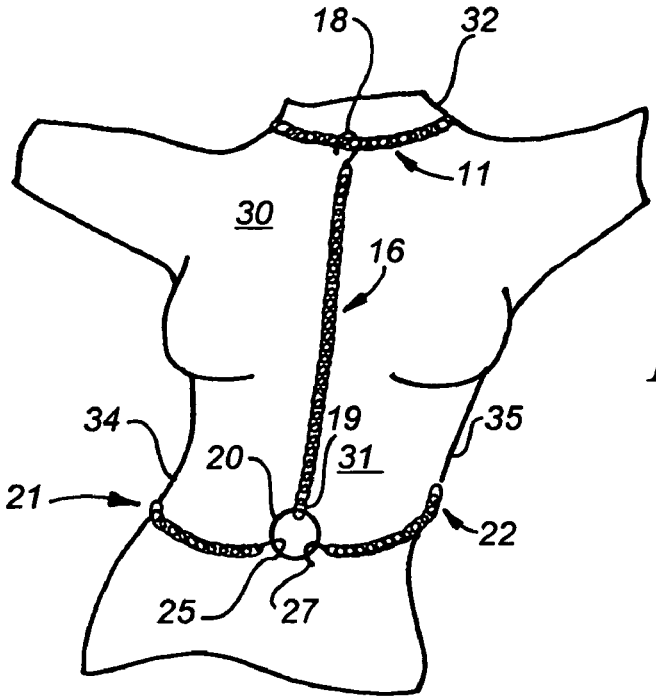
FIG. 2 is a front view of a portion of the body of a woman illustrating the mode of operation of the invention.
Figure 3:
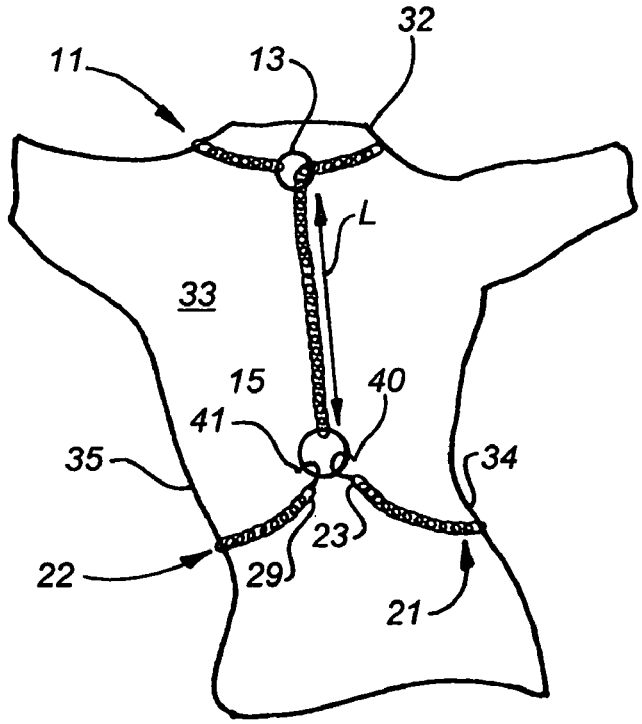
FIG. 3 is a back view of the body of the woman of FIG. 2 further illustrating the mode of operation of the invention.

After chain 11 is fit around the neck of the user to form a necklace, portion 11A hangs down the back along the spine of the user; chains 21 and 22 hang downwardly from ring 15 over the lower back of the user with clips 25 and 27 free and with ends 23 and 29 connected to ring 15; and chain 16 hangs downwardly over the center of the chest of the user with clip 18 connected to the front of the necklace and with ring 20 over the belly button of the user. The user then wraps the lower end of chain 21 around her waist and takes clip 25 and inserts it in ring 20. The user wraps the lower end of chain 22 around her waist and takes clip 27 and inserts it in ring 20. This completes the fitting of the jewelry assembly. FIGS. 2 and 3 illustrate the jewelry assembly after it is fit to a woman's body.

The ability to adjust the length L (FIG. 3) and to adjust the length of chain 16 is important in the practice of the invention because positioning ring 20 (or end 19 if ring 20 is not utilized) over the user's belly button and then draping chains 21 and 22 around the waist (i.e., lower stomach and sides and lower back) of the user is believed important in complementing a woman's body. Individuals viewing the jewelry of the invention on a user typically believe the ring 20 is attached to or in the woman's belly button. One purpose of the invention is to achieve this effect without requiring that jewelry be secured to a user's body by piercing or other means. The chain 16 and somewhat parallel or concentric necklace and waist chains 21 and 22 produce an effect that appears unique and makes the jewelry unusually appealing and, in many cases, complimentary to the wearer of the jewelry. The jewelry assembly of the invention can be worn over clothes or in conjunction with any mode of dress, but appears particularly appealing when worn with the low riding pants or shorts that are currently in fashion and produce a bare stomach and a visible belly button.

The length L typically is less than the length of chain 16 such that chains 21 and 22 drape somewhat below, typically one-half to three inches below, ring 20 over the stomach of the user, and then extend up and around the sides 34, 35 of the user. The ability to adjust the effective length of portion 11A is therefore important, as is the ability to adjust the effective length of chain 16. Altering the effective length of portion 11A alters to position of ring 15 on the user's back. Altering the effective length of chain 16 alters the position of ring 20 on the user's stomach.

One way to adjust the effective length of chain 16 or of the portion 11A is to maintain the length of chain 16 or potion 11A while increasing or decreasing the length or diameter of the necklace. For example, if a necklace comprises a chain, one end of the chain can consist of a clip or hook that can be inserted anywhere along the chain to alter the length of the chain that extends around the neck of the user. As the length of the chain forming the necklace extending around the user's neck is increased, the necklace hangs lower and increases the effective length of chain 16 and portion 11A because rings 15 and 20 are positioned further down (further away from the user's head) the body of the user. As the length of the chain forming the necklace extending around the user's neck is decreased, the necklace hangs higher and decreases the effective length of chain 16 and portion 11A because rings 15 and 20 are positioned higher up (closer to the user's head) on the body of the user.

Another way to adjust the effective length of chain 16 is to provide a chain 16 that is longer or shorter.

Another way to adjust the effective length of portion 11A is to reduce the size of the necklace by pulling more chain through ring 13 to increase the length L.

Another way to adjust the effective length of portion 11A while maintaining the diameter of the necklace portion of chain 11 is to provide a longer or shorter chain 11.

Figure 4:
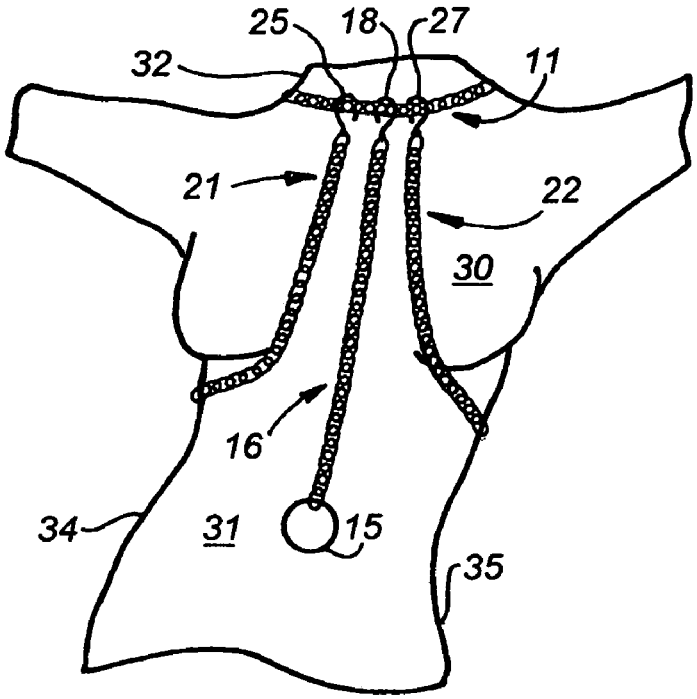
FIG. 4 is a front view of a portion of the body of a woman further illustrating the mode of operation of the invention.
Figure 5:
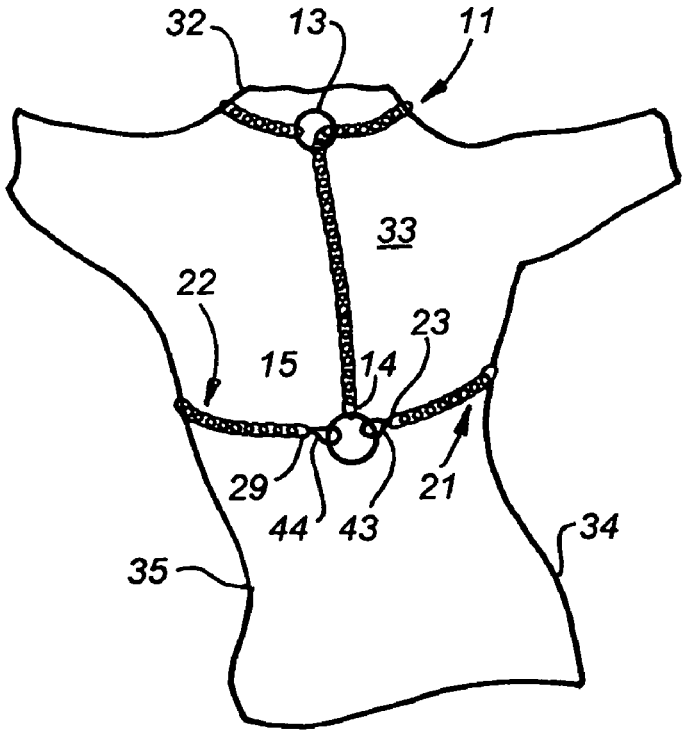
FIG. 5 is a back view of the body of the woman of FIG. 4 further illustrating the mode of operation of the invention.

FIGS. 4 and 5 illustrate an alternate configuration and fitting of the jewelry assembly in which clips 25, 27 are not removably attached to ring 15 but are instead removably attached to the necklace portion of chain 11.

In FIG. 5, loops 43 and 44 fixedly secure ends 29 and 23 of chains 21 and 22, respectively, to ring 15. In FIG. 3, clips or hooks 41 and 40 removably secure ends 29 and 23, respectively, to ring 15.

Figure 6:
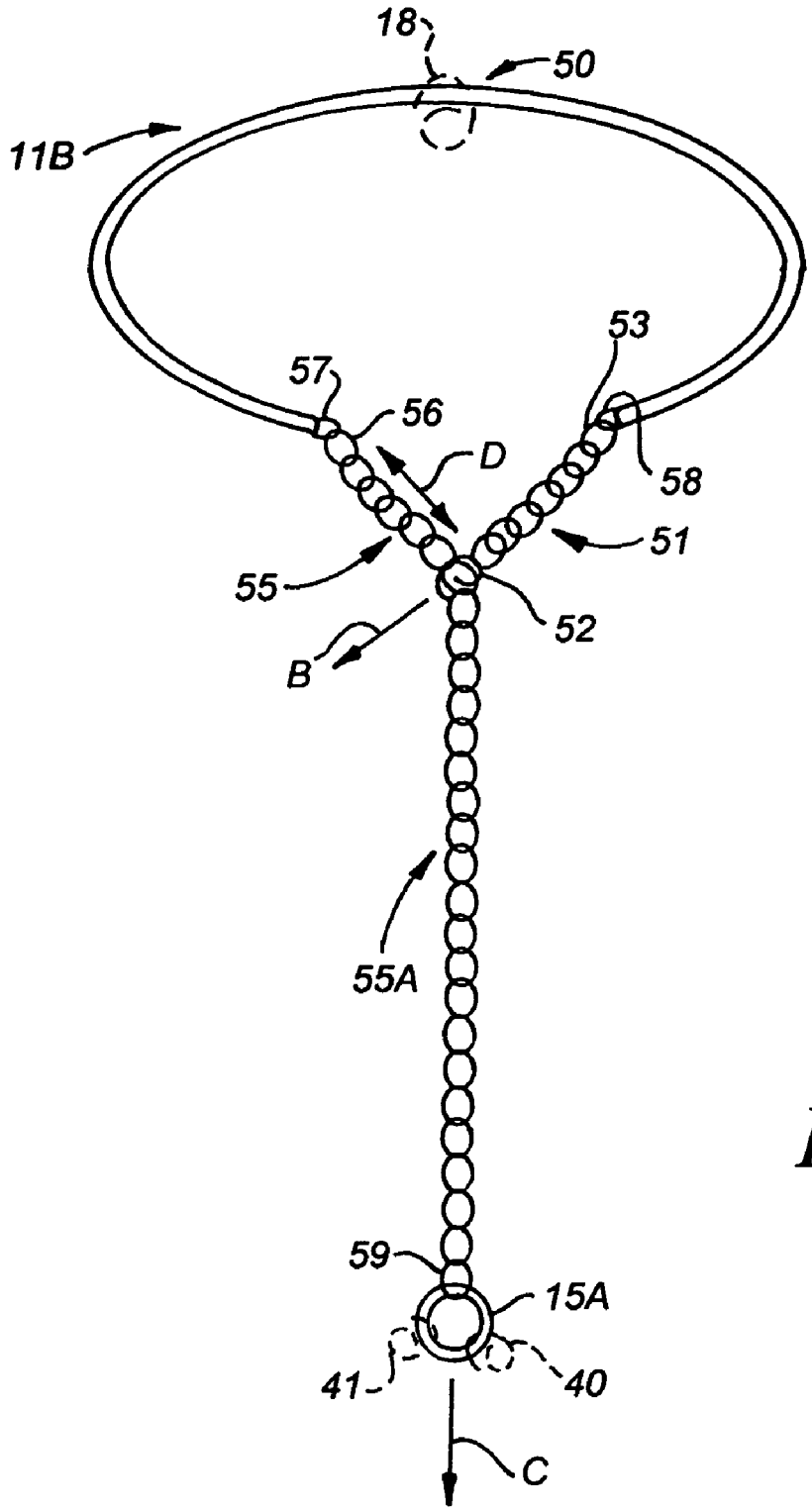
FIG. 6 is a perspective view illustrating an alternate embodiment of the invention; and, FIG. 7 is a perspective view illustrating a further embodiment of the invention.

An alternate embodiment of the invention utilizes the necklace assembly illustrated in FIG. 6. The necklace assembly includes a necklace comprising a resilient C-shaped member 11B with ends 53, 57. Ends 53, 57 can be pulled apart to facilitate placing member 11B around the neck of a woman. After the member 11B is placed around the neck of a woman, ends 53, 57 are carefully released and ends 53 and 57 move toward one another and member 11B resiliently returns to its original C-shape. End 58 of chain 51 is connected to end 53. End 52 of chain 51 comprises a clip that slidably fits around chain 55, or, if desired, that can be clipped into a link of chain 55 such that end 52 will not slide along chain 55. The ability of clip 52 to slide along chain 55 in the manner indicated by arrows D is preferred because the weight of chain 55 (indicated by arrow C) generates a force B that acts on clip 52 and extends chain 51 to form a V-shape comprised of chain 51 and the upper end of chain 55 that extends between end 57 and clip 52. This V-shape structure, along with the chain 16 (not shown in FIG. 6) attached to the front 50 of the necklace by clip 18, tends to maintain section 55A of chain 55 and chain 16 centered on the back and front, respectively, of the user. The V-shape also reduces, in comparison to the ring 13 illustrated in FIG. 1, the forces that act on and tend to draw together ends 53 and 57. The lower portion 55A of chain 55 extends from clip 52 to ring 15A. Portion 55A includes end 59 connected to ring 15A. Clips 40 and 41 of chains 21 and 22 (not shown), respectively, are connected to ring 15A in the manner earlier described, and chains 21 and 22 extend from ring 15A around the sides of a user to a ring 20 (not shown in FIG. 6) at the end of chain 16 (not shown in FIG. 6). FIG. 6 is intended, in particular, to illustrate an alternate necklace—chain construction 11B—55 that can be utilized in the practice of the invention in combination with chains 21, 22, and 16.

Figure 7:
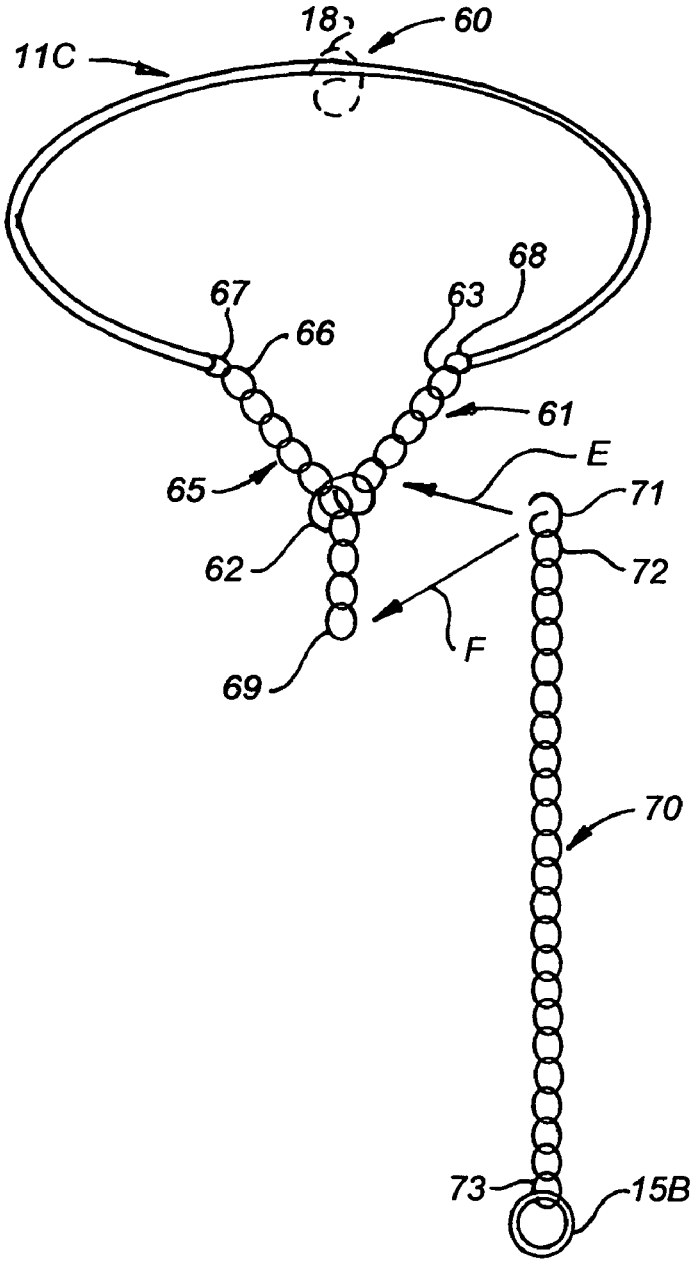

Another embodiment of the invention utilizes the necklace assembly illustrated in FIG. 7. The necklace assembly includes a necklace comprising a resilient C-shaped member 11C with ends 67, 68. Ends 67, 68 can be pulled apart to facilitate placing member 11C around the neck of a woman. After the member 11C is placed around the neck of a woman, ends 67, 68 are carefully released and ends 67 and 68 move toward one another and member 11C resiliently returns to its original C-shape. End 63 of chain 61 is connected to end 68. End 62 of chain 61 comprises a clip that slidably fits around chain 65, or, if desired, that can be clipped into a link of chain 65 such that end 62 will not slide along chain 65. The ability of clip 62 to slide up and down along chain 65 (in the manner that clip 52 slides along chain 55) is preferred because the weight of chain 70—when chain 70 is attached to chains 61 and/or 65 generates a downward force that acts on clip 62 and extends chain 61 to form a V-shape comprised of chain 61 and the upper end of chain 65 that extends between end 67 and clip 62. This V-shaped structure, along with the chain 16 (not shown in FIG. 7) attached to the front 60 of the necklace by clip 18, tends to maintain chain 70 and chain 16 centered on the back and front, respectively, of the user. The V-shaped structure also reduces, in comparison to the ring 13 illustrated in FIG. 1, the forces that act on and tend to draw together ends 53 and 57. Chain 70 preferably is removably attached to chains 61 and/or 65 by placing clip 71 (1) over clip 62 at the bottom of the V-structure formed by chain 61 and the upper end of chain 65, (2) through a link 69 in chain 65 that is located at or below clip 62, or (3) through clip 62. End 73 of chain 70 is connected to ring 15B. Clips 40 and 41 of chains 21 and 22 (not shown), respectively, are connected to ring 15B in the manner earlier described, and chains 21 and 22 extend from ring 15B around the sides of a user to the ring 20 (not shown in FIG. 6) at the end of chain 16 (not shown in FIG. 6). FIG. 7 is intended, like FIG. 6, to illustrate an alternate necklace—chain construction 11C—70 that can be utilized in the practice of the invention in combination with chains 21, 22, and 16.

The construction of necklaces 11B and 11C can vary as desired and can each consist of a length of chain. Utilizing a solid C-shaped length of substantially rigid but resilient wire, plastic, metal, or other material or structure is presently preferred because when necklace 11B, 11C is a chain it is more likely to constrict too tightly the neck of a user.

Any chain referred to and described in the drawings can comprise a cable or other elongate member. The structure and properties of the elongate member can vary as desired, but the elongate members preferably are pliable, readily bend, and are not elastic or stretchable like a rubber band.

Having described my invention in such terms as to enable those of skill in the art to make and practice it, and having described the presently preferred embodiments thereof, I claim:

1. A method to fit a jewelry chain assembly extending over a woman's neck, chest, back, stomach, belly button, and waist to complement the woman's appearance, said method comprising the steps of (a) providing a neck assembly comprising (i) a necklace worn about the woman's neck and having a front and a back, (ii) a first chain to extend from said necklace downwardly over the woman's back, said chain having a first end connected to said back of said necklace and a second end positioned on the woman's back, (iii) apparatus for adjusting the length of said first chain, (iv) a second chain to extend from said necklace downwardly over the woman's chest and stomach, said necklace having a first end connected to said front of said necklace and a second end positioned over the woman's belly button, (v) a third chain having a first end connected to said second end of said first chain and having a second end, (vi) a first clip for detachably securing said second end of said third chain to said second end of said second chain, (vii) a fourth chain having a first end connected to said second end of said first chain and having a second end, (viii) a second clip for detachably securing said second end of said fourth chain to second end of said second chain;

(b) placing said necklace on the woman's neck such that (i) said second chain extends from said necklace downwardly over the woman's chest and stomach and said second end of said second chain is positioned over the woman's belly button, (ii) said first chain extends from said necklace downwardly over the woman's back, (iii) said third and fourth chains extend from said second end of said first chain;

(c) using said first clip to secure said second end of said third chain to said second end of said second chain such that said third chain drapes from the woman's belly button about the woman's waist; and, (d) using said second clip to secure said second end of said fourth chain to said second end of said second chain such that said fourth chain drapes from the woman's belly button about the woman's waist.

2. A method to fit a jewelry chain assembly extending over a woman's neck, chest, back, stomach, belly button, and waist to complement the woman's appearance, said method comprising the steps of (a) providing a neck assembly comprising (i) a necklace worn about the woman's neck and having a front and a back, (ii) a first chain to extend from said necklace downwardly over the woman's back, said chain having a first end connected to said back of said necklace and a second end positioned on the woman's back, said first chain having a length, (iii) apparatus for adjusting slidably the length of said first chain, (iv) a second chain to extend from said necklace downwardly over the woman's chest and stomach, said necklace having a first end connected to said front of said necklace and a second end positioned over the woman's belly button, (v) a third chain having a first end connected to said second end of said first chain and having a second end, (vi) a first clip for detachably securing said second end of said third chain to said second end of said second chain, (vii) a fourth chain having a first end connected to said second end of said first chain and having a second end, (viii) a second clip for detachably securing said second end of said fourth chain to second end of said second chain;

(b) placing said necklace on the woman's neck such that (i) said second chain extends from said necklace downwardly over the woman's chest and stomach and said second end of said second chain is positioned over the woman's belly button, (ii) said first chain extends from said necklace downwardly over the woman's back, (iii) said third and fourth chains extend from said second end of said first chain, and (iv) said length of said first chain is slidably adjusted;

(c) using said first clip to secure said second end of said third chain to said second end of said second chain such that said third chain drapes from said second end of said second chain about the woman's waist; and, (d) using said second clip to secure said second end of said fourth chain to said second end of said second chain such that said fourth chain drapes from said second end of said second chain about the woman's waist.

* * * * *